US007073520B2

(12) United States Patent
Zanello et al.

(10) Patent No.: US 7,073,520 B2
(45) Date of Patent: Jul. 11, 2006

(54) WASHING MACHINE WITH CLOG PROOF LINT FILTER

(75) Inventors: Fabio Zanello, Pordenone (IT); Lucio Valent, Pordenone (IT); Piero Babuin, Cordenons (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 179 days.

(21) Appl. No.: 10/472,013

(22) PCT Filed: May 14, 2002

(86) PCT No.: PCT/EP02/05272

§ 371 (c)(1),
(2), (4) Date: Jan. 23, 2004

(87) PCT Pub. No.: WO02/097184

PCT Pub. Date: Dec. 5, 2002

(65) Prior Publication Data

US 2004/0129034 A1 Jul. 8, 2004

(30) Foreign Application Priority Data

May 25, 2001 (IT) ..... PN20010019 U

(51) Int. Cl.
*B08B 13/00* (2006.01)

(52) U.S. Cl. ..... 134/111; 134/110; 210/459

(58) Field of Classification Search ..... 134/111, 134/110; 210/459, 343; 366/340
See application file for complete search history.

(56) References Cited

U.S. PATENT DOCUMENTS

| | | | | | |
|---|---|---|---|---|---|
| 515,894 | A | * | 3/1894 | Balz | 210/351 |
| 897,734 | A | * | 9/1908 | Knock | 24/184 |
| 2,313,612 | A | * | 3/1943 | Alsop | 210/343 |
| 2,459,476 | A | * | 1/1949 | Landsbergen et al. | 313/261 |
| 2,555,725 | A | * | 6/1951 | Archbold | 68/12.02 |
| 2,575,542 | A | * | 11/1951 | Wubbe | 210/454 |
| 2,750,047 | A | * | 6/1956 | Hasbrouck | 210/343 |
| 3,037,633 | A | * | 6/1962 | Veitel et al. | 210/232 |
| 3,503,526 | A | * | 3/1970 | Crafton | 242/559.2 |
| 3,622,003 | A | * | 11/1971 | Czech et al. | 210/108 |
| 3,624,779 | A | * | 11/1971 | Miller et al. | 210/457 |
| 3,681,947 | A | * | 8/1972 | Cowan | 68/18 F |
| 4,204,967 | A | * | 5/1980 | Bannister | 210/459 |
| 5,120,434 | A | * | 6/1992 | Yoshida | 210/172 |
| 6,820,447 | B1 | * | 11/2004 | Thies et al. | 68/18 R |

FOREIGN PATENT DOCUMENTS

DE 11 94 261 6/1965

(Continued)

OTHER PUBLICATIONS

European Office 0 110482 Jun. 1984.*

*Primary Examiner*—Frankie L. Stinson
(74) *Attorney, Agent, or Firm*—Pearne & Gordon LLP

(57) ABSTRACT

The filter (3) comprises transversal walls (11) forming a labyrinth-like path with the inner surface of a hollow body (6) that is part of the water outlet circuit of the machine. On the peripheral edge of the said transversal walls (11) there are provided serrations (12) adapted to retain foreign bodies and break down the air bubbles that are present in the liquor taken in by the drain pump (4).

4 Claims, 2 Drawing Sheets

FOREIGN PATENT DOCUMENTS

| | | | |
|---|---|---|---|
| DE | 1 710 562 | * | 11/1971 |
| FR | 2 503 281 | * | 10/1982 |
| FR | 2 524 023 | * | 9/1983 |
| GB | 1 526 857 | | 10/1978 |
| JP | 2000-73427 | * | 3/2000 |
| JP | 2000-192522 | * | 7/2000 |

* cited by examiner

FIG.2
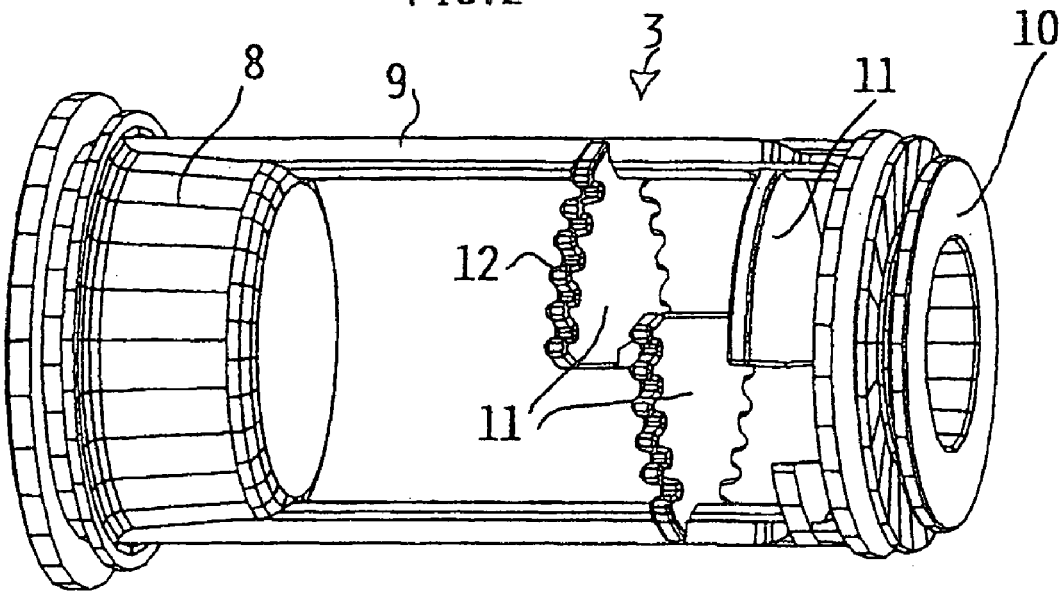
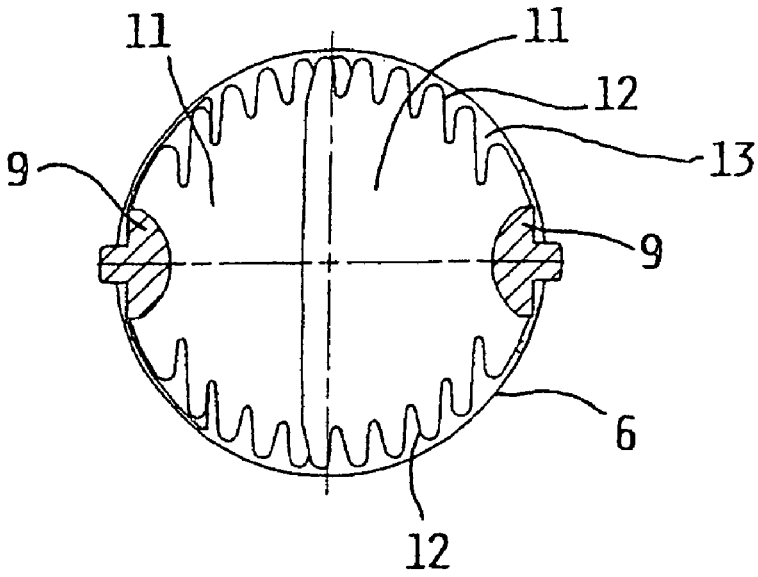
FIG.3

WASHING MACHINE WITH CLOG PROOF LINT FILTER

This application claims the benefit of International Application Number PCT/EP02/05272, which was published in English on Dec. 5, 2002.

The present invention refers to a washing machine, in particular for home use, comprising a washing and/or rinsing water outlet circuit that is provided with a clog-proof lint filter.

Draining the water from the washing tub is a process that in the great majority of the washing machines is generally known to take place through a water outlet circuit, in which there are successively provided a lint filter, a pump and an appropriately upward extending terminal pipe.

The lint filter itself can be substantially made as described and illustrated in EP-A-807 707, i.e. with relatively close and narrow meshes capable of retaining lint and most of the foreign bodies and matters that may end up in the water being let off, so as to effectively protect the impeller of the drain pump.

On the other hand, lint filters of such a kind are quite easily subject to clogging and require frequent maintenance that quite often is disregarded, i.e. neglected by the user.

Use is therefore preferably made of so-called self-cleaning lint filters, eg. of the type described in GB-B-2 276 888, i.e. of the type comprising one or more transversal walls that form a tortuous, labyrinth-like path with rather large passageways so as to be able to intercept and retain bodies and foreign matters of a certain size, while letting smaller and/or less stiff or thick bodies and matters freely through.

Preferably, these lint filters must be capable of being conveniently pulled out to periodical cleaning purposes, so that they usually comprise a filtering structure (comprising the transversal walls) that is substantially circular in its cross-section and is removably inserted in a conduit portion, with respect to which there anyway remains a peripheral passageway. In the case of a lint filter of the self-cleaning type, such a peripheral passageway may undesirably allow relatively large foreign bodies (such as for instance shoe-strings or the like) to pass through, thereby possibly causing the impeller of the drain pump to be locked, ie. to become jammed.

In any case, it should be noticed that air bubbles, such as in particular suds or foam bubbles, tend to most easily form in correspondence of the lint filter, and these bubbles may actually affect the priming conditions of the drain pump, thereby leading to irregular operation, malfunction and noise generation.

It therefore is a purpose of the present invention to provide a washing machine equipped with a simple, low-cost clog-free lint filter that proves effective in overcoming the above-cited drawbacks of the known solutions.

In particular, it is a purpose of the present invention to provide a washing machine of the above cited kind having a clog-proof lint filter that is not only particularly effective in performing its function, but also fully capable of ensuring a substantially correct operation of the drain pump of the washing machine.

According to the present invention, these and further aims are reached in a washing machine with a clog-proof lint filter embodying the characteristics as recited and defined in the appended claims.

Anyway, features and advantages of the present invention may be more readily understood from the description that is given below by way of non-limiting example with reference to the accompanying drawings, in which:

FIG. 2 is a perspective view of the lint filter arrangement shown in FIG. 1; and FIG. 3 is a schematic cross-sectional view of the lint filter arrangement shown in FIG. 2.

Figure 1:
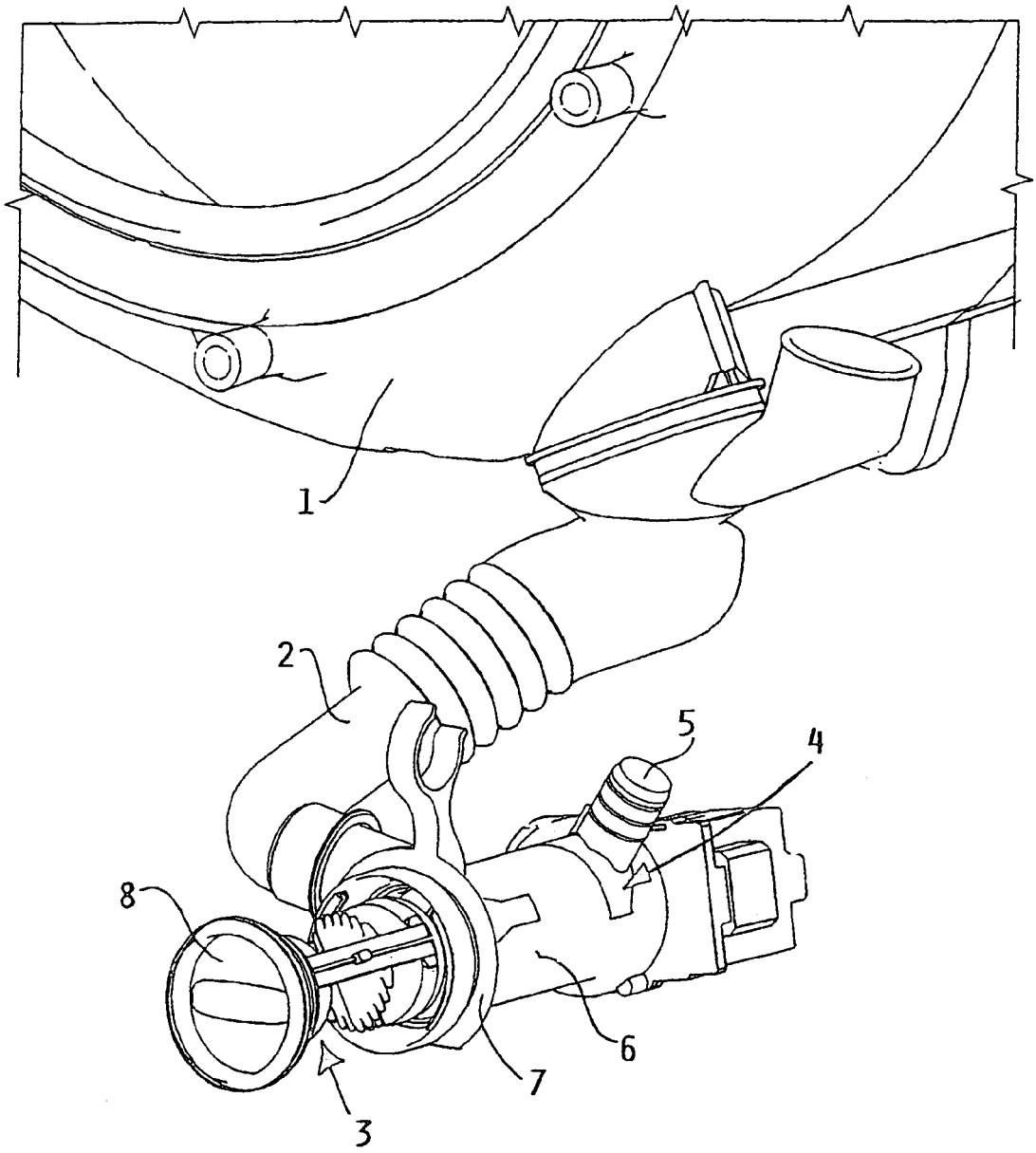
FIG. 1 is a partial view of the water outlet section of the washing machine according to the present invention, with the lint filter in the pulled-out condition thereof.

With reference to the Figures, the washing machine comprises mainly a washing tub 1, the bottom portion of which is connected to a drain (not shown) via a water outlet circuit 2, to which there are connected in series a clog-proof lint filter 3 and a drain pump 4 having a pressure line 5.

In particular, the lint filter 3 is housed in a hollow body 6 arranged between the conduit 2 and the suction side of the pump 4, and is located in a position in which it is conveniently accessible in view of being able to be pulled out through an aperture 7 of said hollow body 6, in a substantially per se known manner.

In a preferred manner, the hollow body 6 has a cylindrical shape, with a substantially horizontal axis, and the filter 3 is structured correspondingly, with a circular cross-section, as better illustrated in FIG. 3.

The lint filter 3 has a structure that is formed by an end portion 8, which is adapted to perform as a closing or plugging cap for the aperture 7 and is connected via longitudinal members 9 to an opposite end portion 10. The latter is preferably given the shape of a circular crown and is arranged adjacent to the suction side of the drain pump 4.

Between said end portions 8 and 10 there are extending from said longitudinal members 9 a plurality of transversal walls 11 (three transversal walls in the example being described here) which are substantially opposing each other, duly spaced from each other and staggered relative to each other, so as to form, jointly with the inner surface of said hollow body 6, a meandering, labyrinth-like flow-path towards the pump 4.

In a per se known manner, the walls 11 are adapted to intercept foreign matters of a certain size, while letting smaller and/or less stiff or thick matters flow through. In this connection, as this can be noticed in FIG. 3, between the peripheral edge of the filter 3 (as defined by the walls 11 when viewed from the top) and the adjacent inner surface of the hollow body 6, a peripheral passageway 13 is defined which might well allow relatively large or coarse bodies (such as for instance shoe-strings or the like) to pass unhindered through.

According to the present invention, this is substantially prevented by the provision of one or more serrations 12, or the like, formed in correspondence of said peripheral passageway 13, which may extend over the entire periphery of the filter.

Preferably, said serrations 12 are provided on at least a certain extent along the peripheral edge of at least one of said walls 11. In the example being described here, two of said walls 11 comprise respective serrations 12 along the entire peripheral edge thereof.

As an alternative thereto, or in addition thereto, one or more ribs 12 may be formed on the inner surface of said hollow body 6.

In all cases, such serrations 12 perform a threefold task, i.e.:

- they practically seize and retain, thereby preventing them from being let through and move towards the pump 4, possible substantially large or coarse foreign bodies that tend to pass through the above cited peripheral passageway;

they advantageously increase the passage cross-section for the liquor through the filter 3; and they break down the air bubbles that are present in the liquor taken in by the drain pump 4, which therefore finds itself under definitely improved priming conditions that boost its performance and reduce the noise generated by it.

It shall be appreciated that the washing machine that has been described here by mere way of example may be the subject of a number of modifications without departing from the scope of the present invention.

So, for instance, considering the conditions according to which such air bubbles and such foreign bodies as shoestrings, or the like, tend basically to be floating in the flow of water being let off, it may be sufficient for said serrations 12 to be provided along just an upper portion of the peripheral edge of at least a wall 11.

On the other hand, in view of boosting the operating efficiency of the lint filter 3, as well as in view of enabling it to be most conveniently introduced in the hollow body 6 without any need for the angular orientation thereof to be made sure of or cared for, it may be preferred that such serrations 12 be provided substantially along the whole peripheral edge of the same lint filter.

It stands as a matter of course that similar considerations apply in the case in which said serrations 12 are formed on the inner surface of the hollow body 6.

The invention claimed is:

1. Washing machine with a clog-proof lint filter (3) included in a water outlet circuit connecting a washing tub (1) of the machine with a drain pump (4), the lint filter (3) being removably inserted in a hollow cylindrical body (6) having an aperature (7) through which the lint filter (3) is able to be pulled out, the lint filter (3) comprising:

a first end portion (8) which is adapted to perform as a plugging cap for the aperture (7) and is connected via longitudinal members (9) to an opposite second end portion (10), the second end portion being adjacent to a suction side of the drain pump (4), and a plurality of transversal walls (11) being provided between the first end portion (8) and the second end portion (10) and extending from the longitudinal members (9), said plurality of transversal walls (11) opposing each other, being spaced apart from each other, and being staggered relative to each other, said plurality of transversal walls (11) cooperating with an inner surface of the hollow body (6) to form a labyrinth-like flow-path towards the drain pump (4), and said inner surface being adjacent to a peripheral edge of at least one of said plurality of transversal walls (11) said inner surface and said peripheral edge defining a peripheral passageway, wherein one or more serrations (12), are provided in correspondence with said passageway (13) so as to retain possible foreign bodies and break down the air bubbles that are present in the liquor taken in by the drain pump (4).

2. Washing machine according to claim 1, wherein said one or more serrations (12) are provided along at least a portion of the peripheral edge of at least one of said plurality of transversal walls (11) of the lint filter (3).

3. Washing machine according to claim 1, wherein said serrations (12) are provided on the inner surface of said hollow body (6).

4. Washing machine according to claim 1, wherein said serrations (12) are provided in correspondence with an upper portion of said passageway (13).

* * * * *